United States Patent [19]

Maghenzani

[11] Patent Number: 4,648,796

[45] Date of Patent: Mar. 10, 1987

[54] CENTRIFUGAL PUMP FOR VERY THICK AND/OR VISCOUS MATERIALS AND PRODUCTS

[75] Inventor: Tersillo Maghenzani, Parma, Italy

[73] Assignee: Pompe F.B.M. S.p.A., Parma, Italy

[21] Appl. No.: 625,917

[22] Filed: Jun. 29, 1984

[30] Foreign Application Priority Data

Jul. 6, 1983 [IT] Italy ..... 46850 A/83

[51] Int. Cl.[4] ..... F04D 7/04

[52] U.S. Cl. ..... 415/215; 415/71; 416/188

[58] Field of Search ..... 415/71, 72, 88, 206, 415/207, 215, 213 R, 213 A, 121 B; 416/183, 184, 185, 188, 245 B

[56] References Cited

U.S. PATENT DOCUMENTS

| | | | |
|---|---|---|---|
| 2,407,748 | 9/1946 | Schmidt | 415/72 |
| 3,446,151 | 5/1969 | Andersson | 415/72 |
| 3,644,056 | 2/1972 | Wiselius | 416/188 |
| 3,692,422 | 9/1972 | Girardier | 415/215 |
| 3,771,900 | 11/1973 | Baehr | 415/215 |
| 4,111,599 | 9/1978 | Stahle | 415/213 A |
| 4,193,737 | 3/1980 | Lemmon | 415/215 |
| 4,347,035 | 8/1982 | Stahle | 415/71 |
| 4,427,336 | 1/1984 | Lake | 415/71 |

FOREIGN PATENT DOCUMENTS

| | | | |
|---|---|---|---|
| 232869 | 4/1964 | Austria | 416/188 |
| 2408741 | 6/1979 | France | 416/188 |

*Primary Examiner*—Robert E. Garrett
*Assistant Examiner*—John Kwon
*Attorney, Agent, or Firm*—Birch, Stewart, Kolasch & Birch

[57] ABSTRACT

A centrifugal pump used for conveying very thick and/or viscous materials and products which comprises a screw impeller of at least one start, of which the component blade, which is in the form of a helix (8) having a pitch which increases in the material feed direction, has a slightly conical outer profile, is wound on a highly conical core (5) smoothly joined to a base disc (6), and at its downstream terminal portion is twisted towards the core (5) to assume the configuration of a delivery vane (9) forming an acute angle with the disc (6) and disposed along a chord thereof, and supporting an overlying circumferential ring (10) which defines a closed delivery duct for the material.

5 Claims, 4 Drawing Figures

CENTRIFUGAL PUMP FOR VERY THICK AND/OR VISCOUS MATERIALS AND PRODUCTS

In many industrial sectors, thick and viscous materials which are difficult to pump have to be circulated within respective plants. For example, in modern plants for the continuous concentration of liquid foodstuffs and in chemical process plants very high concentrations and/or thickness levels are attained, in particular in the last stages of the process, so as to make normal circulating pumps ineffective to the point of causing their total blockage. This is due to the fact that an increase in product concentration leads to a considerable reduction in its liquidity, and thus to a considerable increase in the friction which it encounters as it passes through the circulating pumps and conveying pipes.

Furthermore, in such plants the product is very often concentrated in environments under vacuum. Consequently, circulating pumps for handling very thick and/or viscous products and materials must have high suction capacity and good hydraulic efficiency, and must have very small friction-generating surfaces and large product passages.

For handling thick or viscous products, pumps are known comprising an impeller substantially in the form of a screw wound at a constant pitch on a conical core and having a conical outer profile, so that the head derives mainly from the reduction in the cross-section of the fluid passage duct between downstream and upsteam.

In these known pumps, the helical screw blade reduces in height, by virtue of the different degree of taper between its outer edge and the core, until it disappears at the flat base of the latter, into which it smoothly joins. In this manner, a toroidal channel disposed at the end of the screw collects the liquid in order to enable it to be discharged tangentially. The toroidal channel, which can be compared to the header of a centrifugal pump, has however a mere collecting function, as the vanes which help to deliver the liquid at a sufficient velocity are lacking.

The use of these known pumps has shown that they have good throughput and hydraulic efficiency characteristics, but they are subject to a considerable deficiency in hydraulic equilibrium, and thus to excessive mechanical unbalance and consequently high stresses. Furthermore, these pumps are difficult to adapt to the requirements of different plants because reducing the impeller diameter results in an unacceptable reduction in the main pump characteristics such as throughput, head, suction capacity and efficiency.

Circulating pumps are also known comprising an impeller with three or more blades, i.e., comprising three or more equidistant helices which are wound at a more or less constant pitch on the same conical core.

These known pumps have the drawback of passages which reduce in size as the number of helices increases, and thus have very large friction-generating surfaces which oppose the circulation of thick and viscous products.

Vortex pumps, i.e., with their impeller set back, are also known and have proved particularly suitable for handling products of high viscosity but have a poor suction capacity, very low efficiency and excessively flat characteristic curves.

Thus generally, the known types of circulating pumps have acceptable operation for materials of relatively low thickness or viscosity, whereas the use of the same pumps for very thick and viscous products which are obtained from modern multi-stage concentration plants results in a drastic reduction in their throughput, head and efficiency characteristics and, as stated, the pump can become blocked in certain cases thus leading to stoppage of the plant and its obvious consequences.

Moreover, the best and most efficient known pumps are limited in their application to the extent that they can handle thick materials or suspensions containing a maximum of 30% of solid residue, and viscous materials or solutions having a maximum viscosity of 40° Engler.

The present application provides and protects a pump of special design, which is able to handle thick products containing up to 40–45% of solid residue, and viscous products having a viscosity of up to 60°–65′ Engler, while offering throughput, efficiency and head characteristics which are very close to pumps which convey to normal liquid products.

The pump according to the present invention is of the centrifugal type, provided with an impeller comprising one or two blades, preferably two blades, which extend upstream in the form of two helical blades wound on a conical core at a pitch which decreases towards the vertex of the core. In other words, starting from the material inlet, the first portion of each blade is in the form of a helix having a pitch which increases from upstream to downstream and wound about a highly conical core, the helix having a slightly conical outer profile. In proximity to the base of the core where the latter smoothly joins into a plate orthogonal to the impeller axis, the helix is twisted so that its last portion is in the form of a delivery vane which forms an acute angle with the orthogonal plate, and is disposed along a chord of this plate which is very close to its circumferential edge.

The vane lies between the plate and an upper ring, which define the delivery section for the pumped product.

Because of the preferable use of two helices and respective vanes, the impeller is perfectly balanced, and its inlet part, in which the helices have their portions of smaller pitch, provides high suction capacity which enables it to operate correctly even when its suction side is connected to the environment under vacuum.

In addition, the intermediate greater-pitch portions of the two helices form a member for axially thrusting the material, which is thus fed in compact form to the inclined chordal vanes which together with the upper ring constitute an extremely effective centrifugal delivery member. The fact that the outer profiles of the helices are slightly conical whereas the connecting core is highly conical means that two particularly large passages of decreasing cross-section are provided which, as stated, enable the pump to handle very thick and very viscous products without any significant alteration in its throughput, head and efficiency characteristics.

The constructional characteristics and merits of the present invention will be more apparent from the detailed description given hereinafter with reference to the figures of the accompanying drawings, which illustrate a particular preferred embodiment thereof by way of non-limiting example.

Figure 1:
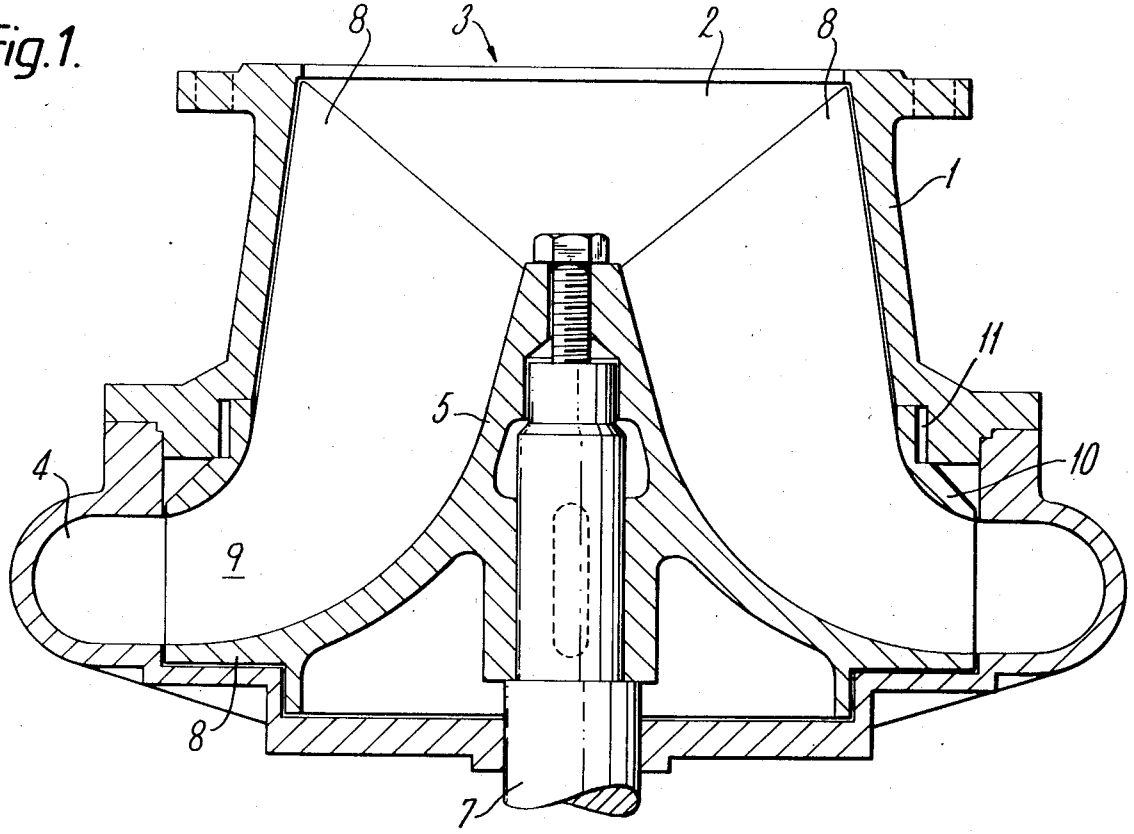
FIG. 1 is a partial cross section view of the invention in the embodiment comprising two impellers.

From the figures, and in particular FIG. 1, it can be seen that the invention comprises a stator element or casing 1 in which there is provided a frusto-conical chamber 2 comprising a suction port 3. At the opposite end to the suction port there is a normal volute 4 for collecting and evacuating the material or product. The two fixed bodies which form the operating chamber 2 and collection volute 4 are joined together by respective flanges, between which suitable sealing gaskets are interposed. In the frusto-conical chamber 2 at the end comprising the volute 4, there is coaxially disposed a conical core 5 which is smoothly joined at its base to a transverse disc 6, the disc being driven by a drive shaft 7 which is idly mounted through the casing 1.

The core 5 extends longitudinal substantially through ⅔ of the chamber 2, and the cone angle at its vertex is of the order of 30°–40°, and preferably 36°.

The core 5 constitutes the shank from which two equal helically extending blades 8 branch, their winding pitch increasing in the direction from the suction mouth 3 to the delivery volute 4. Moreover, as can be better seen in FIG. 2, the front ends of said two helices 8 project beyond the vertex or point of the core 5, to terminate immediately to the side of the suction port 3, whereas their rear terminal portions gradually twist as they approach the disc 6 by being bent towards the core 5, in order to form two diametrically opposing vanes 9 which terminate in two chamfered portions 99 disposed in line with the circumferential edge of the disc 6. Said bending is clearly visible in FIG. 4. From FIGS. 3 and 4 it can be also seen that the two vanes 9 form an acute angle with the base disc 6 and are disposed along two chords which are very close to the circumferential edge of said disc.

In addition, said vanes 9 are disposed in front of the mouth of the volute 4 and extend axially through a distance practically equal to the width of said mouth (FIG. 1).

Immediately upstream of this latter, ie at the terminal downstream part of the operating chamber 2, there is provided a circumferential recess 11 which forms a seat for receiving a ring 10, the inner surface of which forms a direct continuation of the operating chamber 2 and acts as the element by which the chamber is smoothly joined to the volute 4. Said ring 10 is disposed overlying the two diametrically opposing chordal vanes 9, and has an inner transverse curvature which exactly follows the corresponding outer profile of the twisted portions of the helices 8, with which it is rigid.

Again, as can be clearly seen in FIG. 1, the ring 10 and the terminal part of the vanes 9 are external to the conical surface defined by the operating chamber 2, to thus form a delivery member which is of large diameter and thus very efficient with regard to head.

Finally, the outer edges of profiles of the two helices 8 exactly fit inside the chamber 2, of which the cone angle at the vertex is between 13° and 19°, and preferably 16°.

Figure 2:
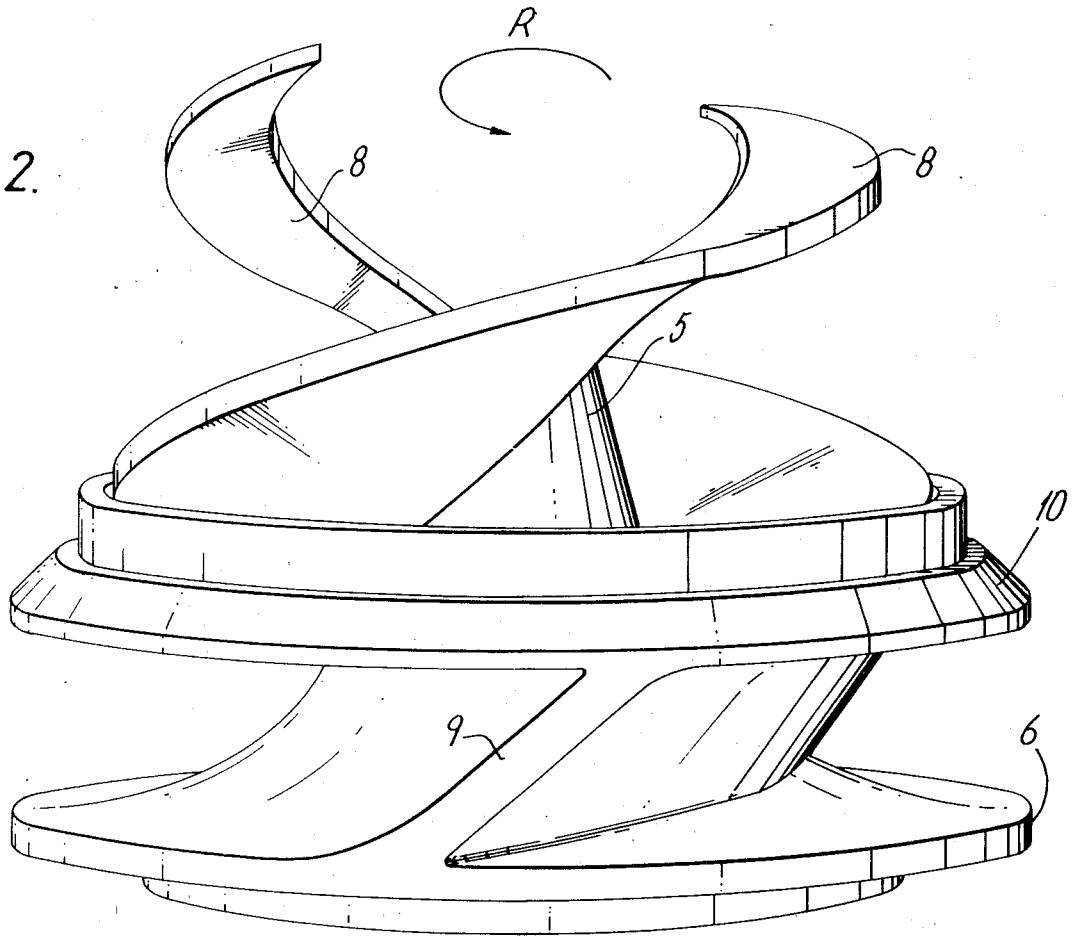
FIG. 2 is a perspective front-side view of the pump impeller.
Figure 3:
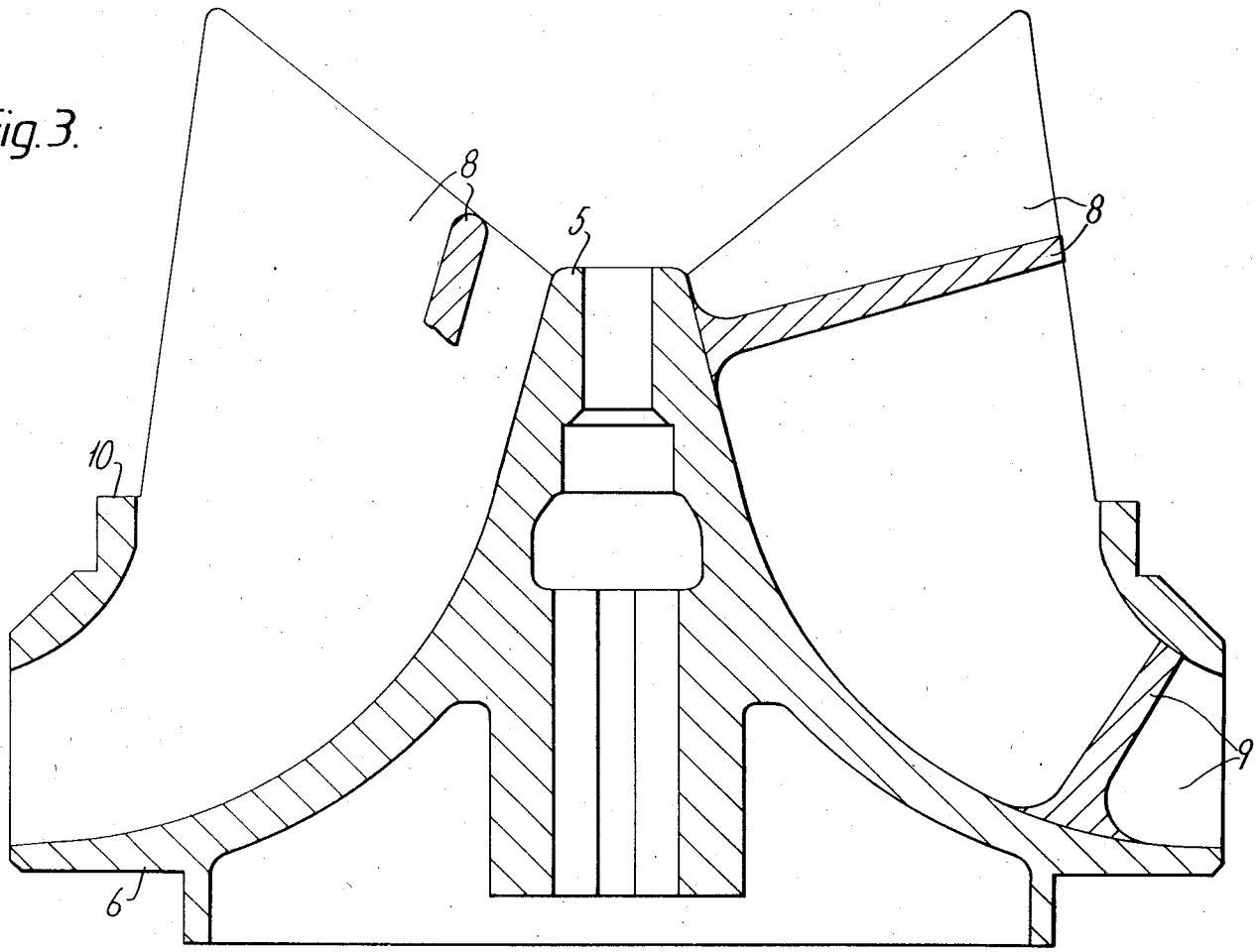
FIG. 3 is a longitudinal section through the impeller.
Figure 4:
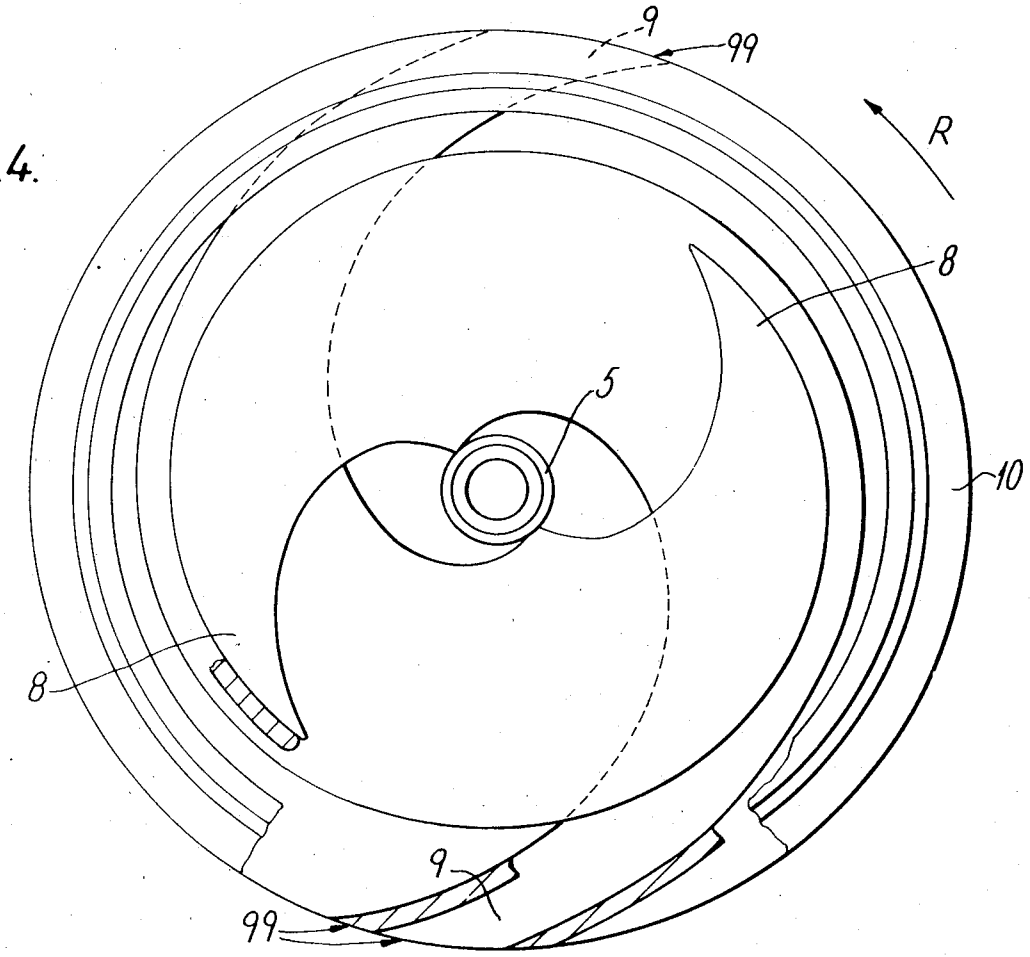
FIG. 4 is a front view thereof.

The direction of rotation of the impeller is shown by the arrow R in FIGS. 2 and 4.

It is apparent at this point that the double blading 8 means that the described impeller is perfectly balanced, and the small-pitch front portions of the two helices 8 provide high suction capacity which enables the pump to operate correctly even when its suction side is connected to environments under high vacuum.

In addition, the intermediate large-pitch portions of increasing height of the two helices provide a structure for axially thrusting the material, which is fed continuously and/or in compacted form to the delivery member constituted by the two vanes 9 and ring 10, so as to enable the invention to handle very thick and/or very viscous products.

This is also due to the fact that combining the small taper of the outer profile of the helices 8 with the accentuated taper of the core 5 provides a pair of large passages of decreasing cross-section (FIG. 1), which ensures the compacting of the material being pumped.

Essentially, by virtue of the aforesaid characteristics, the pumped fluid is compelled to follow a path which is initially practically axial, and becomes increasingly more radial as it approaches the delivery zone defined by the ring 10.

From tests carried out it has been found that the pump under examination is able to handle very thick and/or very viscous products while maintaining its main efficiency, throughput and its head characteristics are practically equal to those relative to materials which are much less thick and much less viscous, i.e., substantially liquid.

The same tests have shown that the invention is able to handle thick products or suspensions containing up to 40–45% of dry residue and viscous products or solutions of viscosity up to 60°–65° Engler without problems.

The same operating characteristics are obtained when the impeller according to the present invention comprises a single helix, obviously of the aforesaid type and combined with a ring 10.

The invention is not limited only to the embodiments heretofore described, and modifications and improvements can be made thereto without departing from the scope of the present invention, the main characteristics of which are summarized in the following claims.

I claim:

1. A centrifugal pump for conveying very thick and/or viscous materials and products comprising a casing which defines a frusto-conical operating chamber provided with a suction port and a delivery volute, a screw impeller rotatably mounted in the operating chamber, the first portion of its blade extending in the form of a helix with a slightly conical outer profile, the pitch of said blade increasing from upstream to downstream with the orientation of the helix surface varying accordingly from nearly horizontal to nearly vertical, said screw impeller being wound about a highly conical core which smoothly joins into a base disc, orthogonal to the axis of rotation, the last portion of the impeller blade being twisted by bending towards the core to assume the form of a delivery vane which is superimposed by a ring which is rigid therewith and forms an acute angle with the base disc, and is orientated along a chord which is very close to the circumferential edge of the base disc, said highly conical cone cooperating with the slightly conical wall of the casing to define passages of decreasing cross-sections which functions to increase the speed of the materials being conveyed therethrough.

2. The pump as claimed in claim 1, wherein the free end of said at least one delivery vane terminates in a chamber disposed in line with the circumferential edge of the base disc, said delivery vane being located in front of the mouth of the delivery volute, and has a length equal to the width of said mouth.

3. The pump as claimed in claim 1, wherein said ring has an arcuate transverse configuration which internally mates exactly with the outer profile of said at least one helix and is received in a respective circumferential seat disposed immediately upstream of the volute to form a direct continuation of the operating chamber and to form the surface which smoothly joins the operating chamber to the volute, and extends longitudinally such as to involve the twisted terminal portion of said at least one helix.

4. The pump as claimed in claim 1, wherein the ring and the terminal portion of said at least one delivery vane are located external to and as a continuation of the conical surface of the operating chamber to form a delivery member of relatively large diameter.

5. The pump as claimed in claim 1, wherein the angle at the vertex of the outer profile of said at least one helix (8) is between 13° and 19°, and the angle at the vertex of the core is between 30° and 40°.

* * * * *